US006157906A

United States Patent [19]

Nicholls et al.

[11] Patent Number: 6,157,906

[45] Date of Patent: Dec. 5, 2000

[54] METHOD FOR DETECTING SPEECH IN A VOCODED SIGNAL

[75] Inventors: Richard Brent Nicholls, Sunrise; Chin Pan Wong, Weston; Martin Thuo Karanja; Patrick Joseph Doran, both of Plantation; David James Graham, Davie, all of Fla.

[73] Assignee: Motorola, Inc., Schaumburg, Ill.

[21] Appl. No.: 09/127,925

[22] Filed: Jul. 31, 1998

[51] Int. Cl.[7] ..... G10L 11/06

[52] U.S. Cl. ..... 704/214; 704/215; 704/223

[58] Field of Search ..... 704/200, 233, 704/208, 207, 214, 210, 215, 219, 223

[56] References Cited

U.S. PATENT DOCUMENTS

| | | | |
|---|---|---|---|
| 4,959,865 | 9/1990 | Stettiner et al. | 704/233 |
| 5,579,431 | 11/1996 | Reaves | 704/214 |
| 5,617,508 | 4/1997 | Reaves | 704/233 |
| 5,657,422 | 8/1997 | Janiszewski et al. | 704/229 |

*Primary Examiner*—Richemond Dorvil

*Attorney, Agent, or Firm*—Scott M. Garrett

[57] ABSTRACT

A digital signal processor (100) receives a digitally vocoded signal (102), and calculates a staggered average value (404) from the frame energy of each received frame, or the product of the frame energy and a voicing value. While the staggered average value is above a threshold voice indicator value, speech is declared present.

17 Claims, 8 Drawing Sheets

FRAME ENERGY
FRAME
$t_1$
404
402
406
400

METHOD FOR DETECTING SPEECH IN A VOCODED SIGNAL

This application is related to co-pending application entitled "Method For Suppressing Speaker Activation In A Portable Communication Device Operated In A Speakerphone Mode" having U.S. patent application Ser. No. 09/127,692; to co-pending application entitled "A Method For Selectively Including Leading Fricative Sounds In A Portable Communication Device Operated In A Speakerphone Mode", and having U.S. patent application Ser. No. 09/127,536; and to co-pending application entitled "Method And Apparatus For Providing Speakerphone Operation In A Portable Communication Device" and having U.S. patent application Ser. No. 09/127,348, of said applications being commonly assigned with the present application and filed evenly herewith.

TECHNICAL FIELD

This invention relates in general to speech processing, and more particularly to detecting speech in a digitally vocoded signal.

BACKGROUND OF THE INVENTION

Speech processing is performed in numerous areas for a wide variety of applications, such as voice recognition, speech compression, and digital telephony to name a few examples. Speech processing is a complex art, often relying on sophisticated algorithms and equipment. In many instances, and particularly real time applications performed by equipment with limited processing ability, it is not possible to dedicate all signal processing resources to speech processing. At the same time, it is often the case in such instances that speech processing is used to detect the presence of speech in a signal in order to take some action. For example, in digital speech compression, rather than process and store periods of silence in a speech segment, when speech is not present, only minimal processing is necessary. However, to do so requires the ability to determine when a speech segment is speech and when it is silence. In many instances fricative portions of speech can appear to be background noise, and thus may be omitted, or not detected properly.

At the same time, other areas of speech processing are becoming more complex. For example, speech encoding is now routinely used to compress speech for mobile communication systems. This type of speech processing is referred to as vocoding. In vocoding speech information is sampled and framed. An example of frame could be a 30 millisecond section of speech. Through the process of vocoding, as is known in the art, the frame is mapped to one of a plurality of symbols representing parts of speech, and other parameters are generated corresponding to the frame of speech so that another apparatus decoding the vocoded signal can reconstruct the sampled section of speech. In order to perform further processing, such as speech detection, by conventional means, would require more sophisticated, and therefore more expensive equipment. In consumer equipment it is preferable to reduce material cost, and therefore there is a need for a simple and reliable method of detecting speech.

DETAILED DESCRIPTION OF A PREFERRED EMBODIMENT

Figure 1:
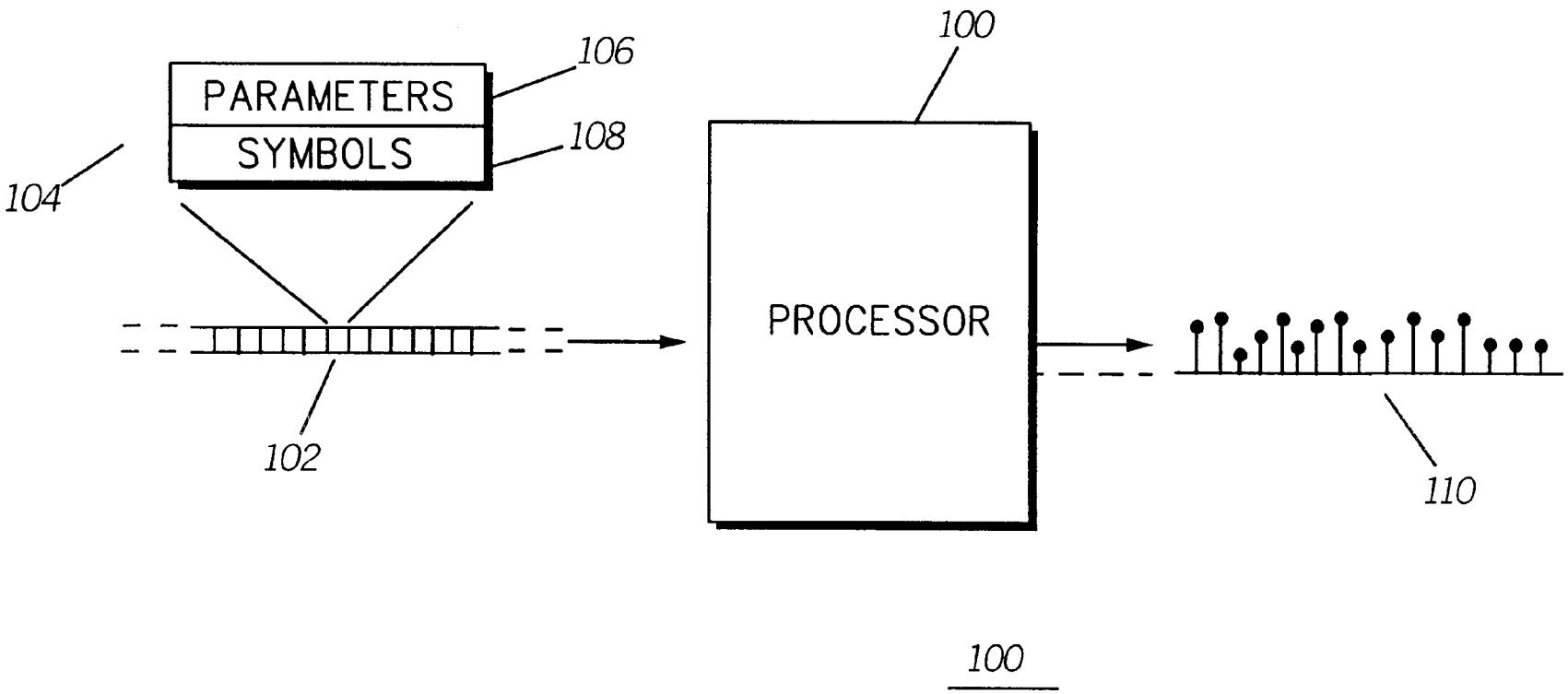
FIG. 1 shows a block diagram of a speech processor, in accordance with one embodiment of the invention.

While the specification concludes with claims defining the features of the invention that are regarded as novel, it is believed that the invention will be better understood from a consideration of the following description in conjunction with the drawing figures, in which like reference numerals are carried forward.

The invention solves the problem of detecting speech without requiring additional speech processing resources by taking advantage of parameters already provided in popular vocoding schemes. In particular, the frame energy value and voicing value are made use of to define a staggered average value which is compared to a threshold. The threshold may be a preselected constant threshold, but preferably it is a dynamic value based on an average background noise value. Furthermore various ways of calculating the staggered average value are taught.

Referring now to FIG. 1, which shows a block diagram of a speech processor 100, in accordance with one embodiment of the invention. The speech processor receives a vocoded signal 102 from some source, as may be the case in a digital communication system. The vocoded signal is comprised of a succession of frames. By vocoded signal it is meant a speech signal encoded by a vocoder. Each frame 104 typically has certain parameters 106 and symbols 108 used to reconstruct the section of speech it represents. The processor 100 decodes the vocoded speech by mapping the symbol to speech pattern, and modifying it according to the parameters, as is known in the art. In the preferred embodiment, the vocoding is done according a scheme known a vector sum excited linear predictive (VSELP) coding, and includes with each frame a frame energy value and a frame voicing value corresponding to the frame. Upon decoding the vocoded signal, a sampled speech signal 110 is produced.

Figure 2:
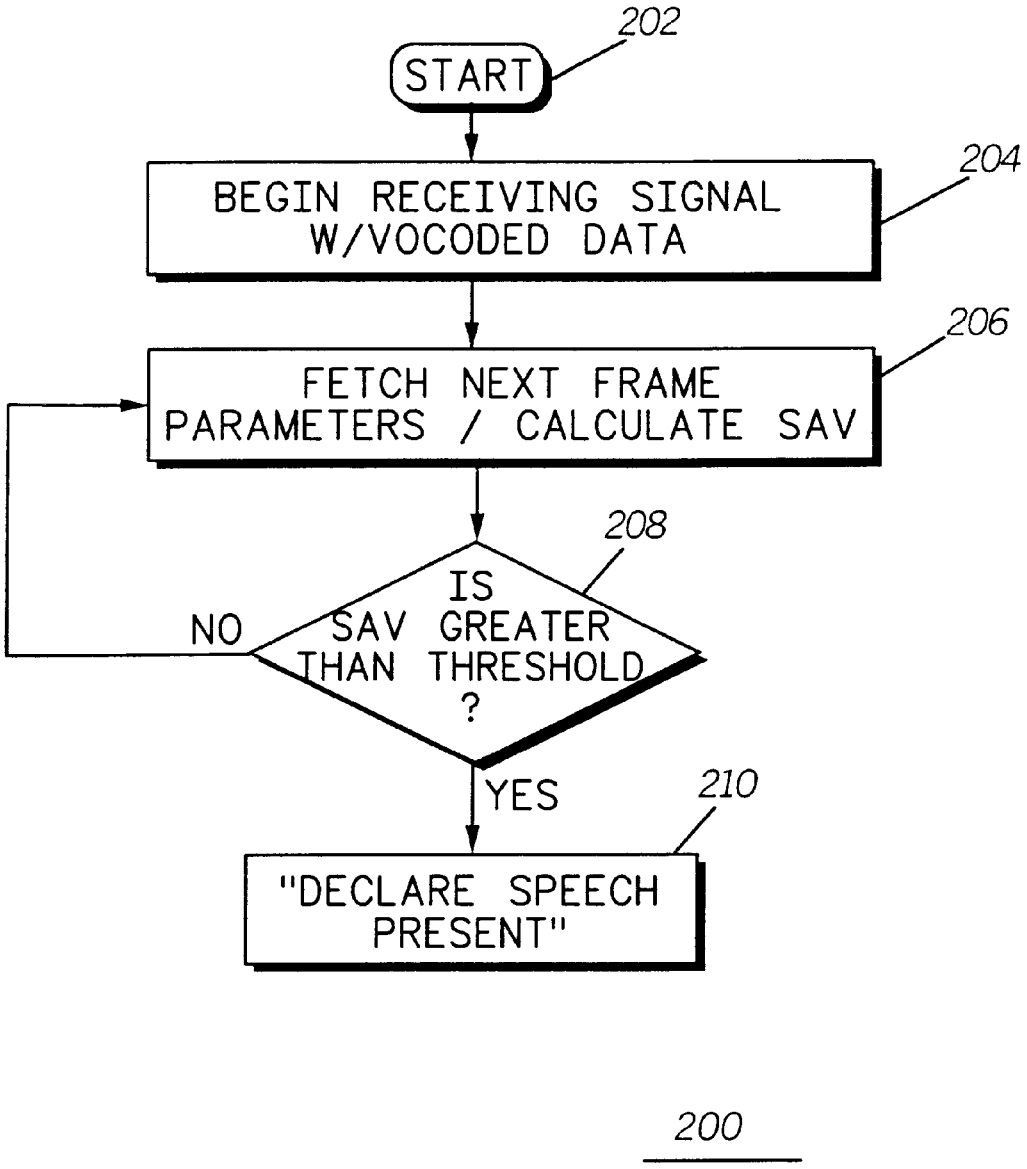
FIG. 2 shows a flow chart diagram of a method for determining when to declare speech present in a digitally vocoded signal, in accordance with one embodiment of the invention.

Referring now to FIG. 2, there is shown a flow chart diagram 200 of a method for determining when to declare speech present in a digitally vocoded signal, in accordance with one embodiment of the invention. At the start 202 of the method, the processor is powered and ready to begin processing in accordance with the methods disclosed hereinbelow. First, the processor begins receiving a vocoded signal (204). The processor will then fetch (206) the first, or next frame and frame parameters. The processor begins calculating a staggered average value. By staggered average, it is meant that changes in one direction of a given parameter, such as the frame energy value, change the staggered average value to the current parameter value, while changes in the other direction result in the staggered average value being adjusted by an averaging function, resulting in a decay from the previous value. After fetching the next frame parameters and calculating the staggered average value, the processor executes a decision block 208, to determine if the staggered average is greater than the threshold voice indicator value. If the staggered average value is greater than the threshold voice indicator value, then speech is declared present (210).

Figure 3:
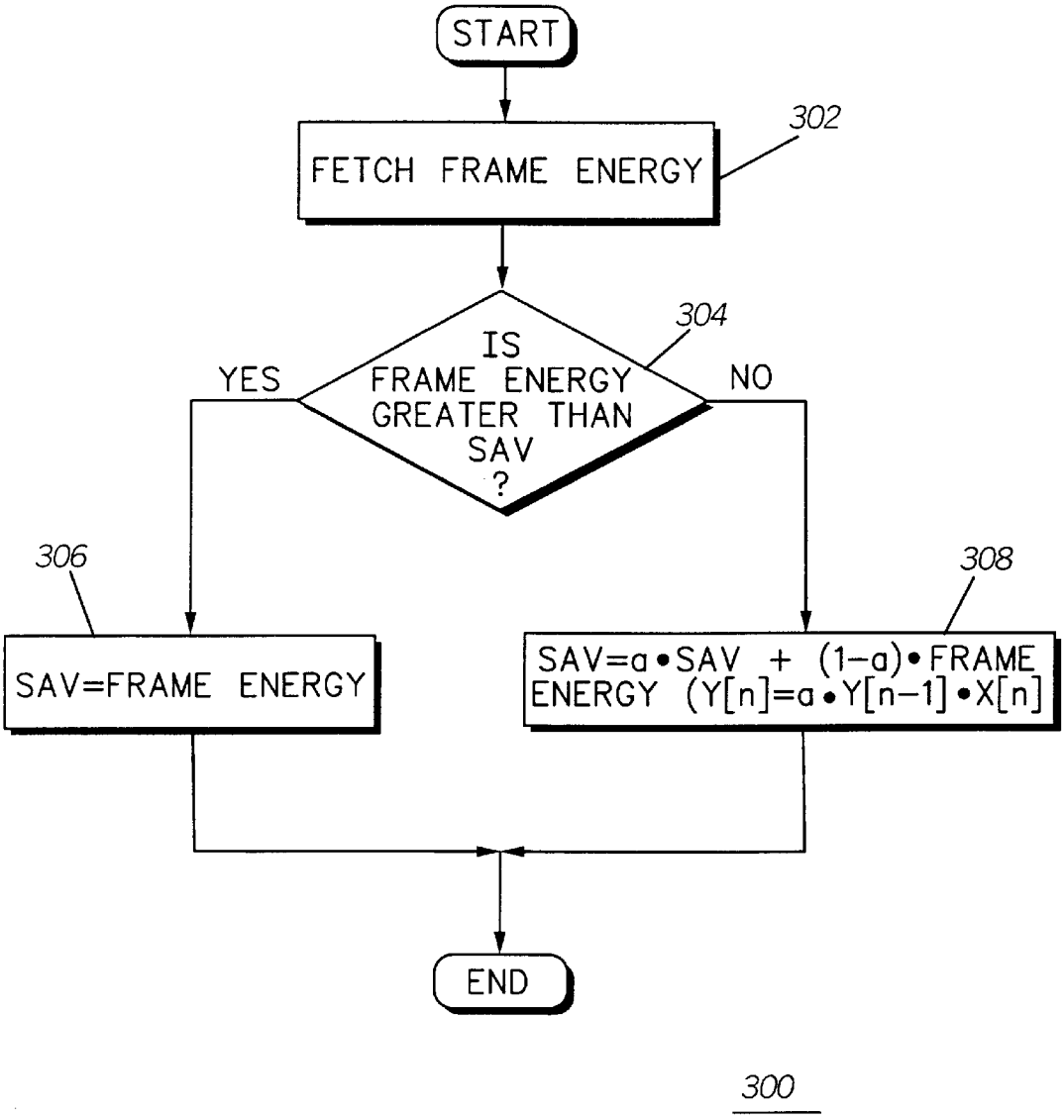
FIG. 3 shows a flow chart diagram of a method for updating parameters used in detecting speech in a digitally vocoded signal, in accordance with one embodiment of the invention.

Referring now to FIG. 3, there is shown a flow chart diagram 300 of a method for updating parameters used in detecting speech, in accordance with one embodiment of the invention. The whole of what is shown in FIG. 3 is performed in box 206 of FIG. 2. First, the processor loads or fetches the frame energy value (302) of the current frame. Next a decision is performed (304), where the frame energy value is compared to the staggered average value (SAV). Initially, the staggered average value may be set to any value, but zero is appropriate. If the frame energy is greater than the staggered average value, the staggered average value is set equal to the frame energy value, as in box 306. However, if the present staggered average value, meaning the staggered average value that was previously determined, is greater than the current frame energy value, than the current staggered average value is calculated by reducing the present staggered average value by an averaging factor (308). The averaging factor may be a preselected constant, but in the preferred embodiment it has the form of:

$y[n]=a\cdot y[n-1]+(1-a)\cdot x[n]$, where:

- $y[n]$ is the current staggered average value;
- $a$ is a scaling factor having a value from zero to one, preferably at least 0.7, and more preferably in the range of 0.8 to 0.9;
- $y[n-1]$ is the present staggered average value; and
- $x[n]$ is the current frame energy value.

Figure 4:
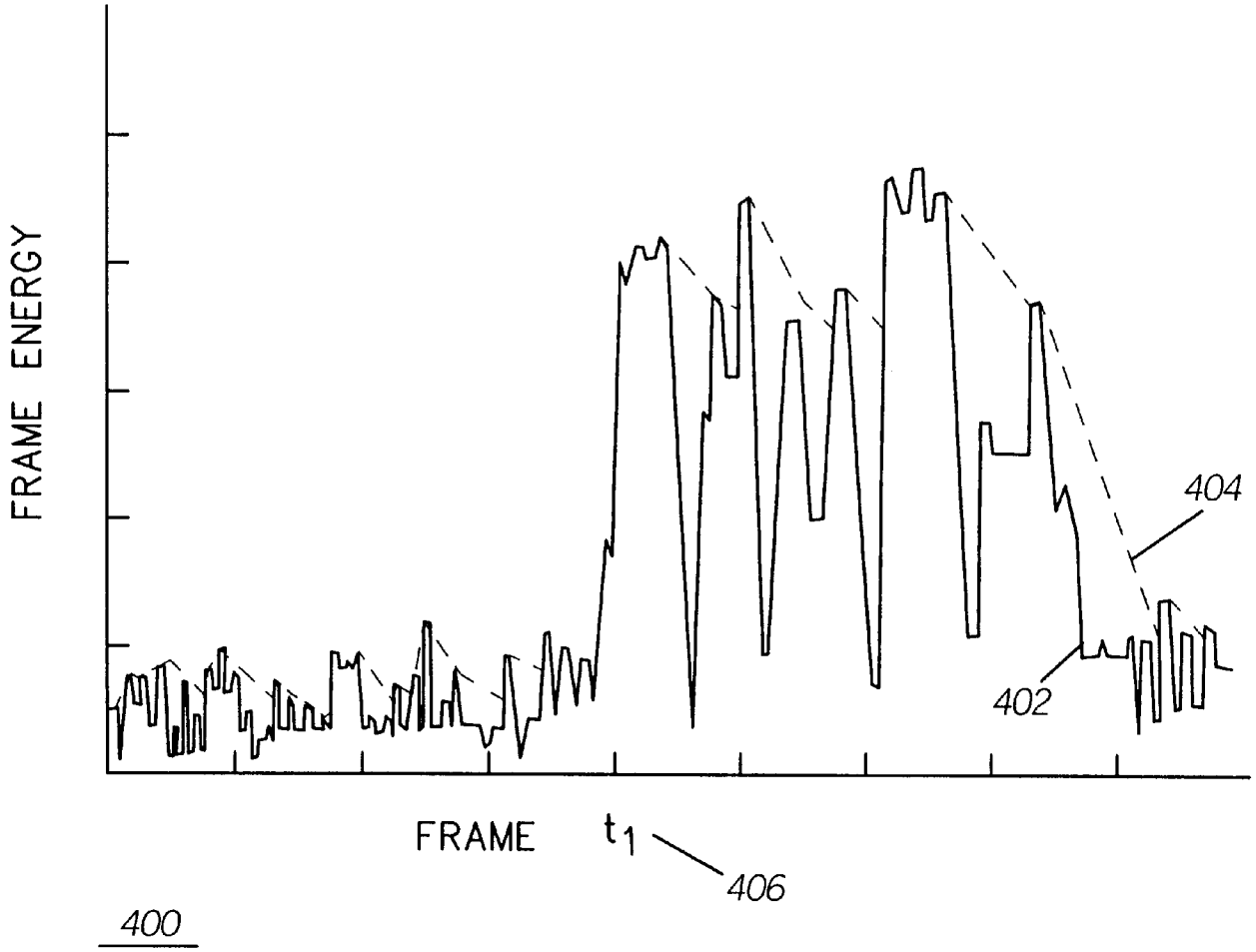
FIG. 4 shows a graph of frame energy over time and a staggered average value derived therefrom, in accordance with one embodiment of the invention.
Figure 5:
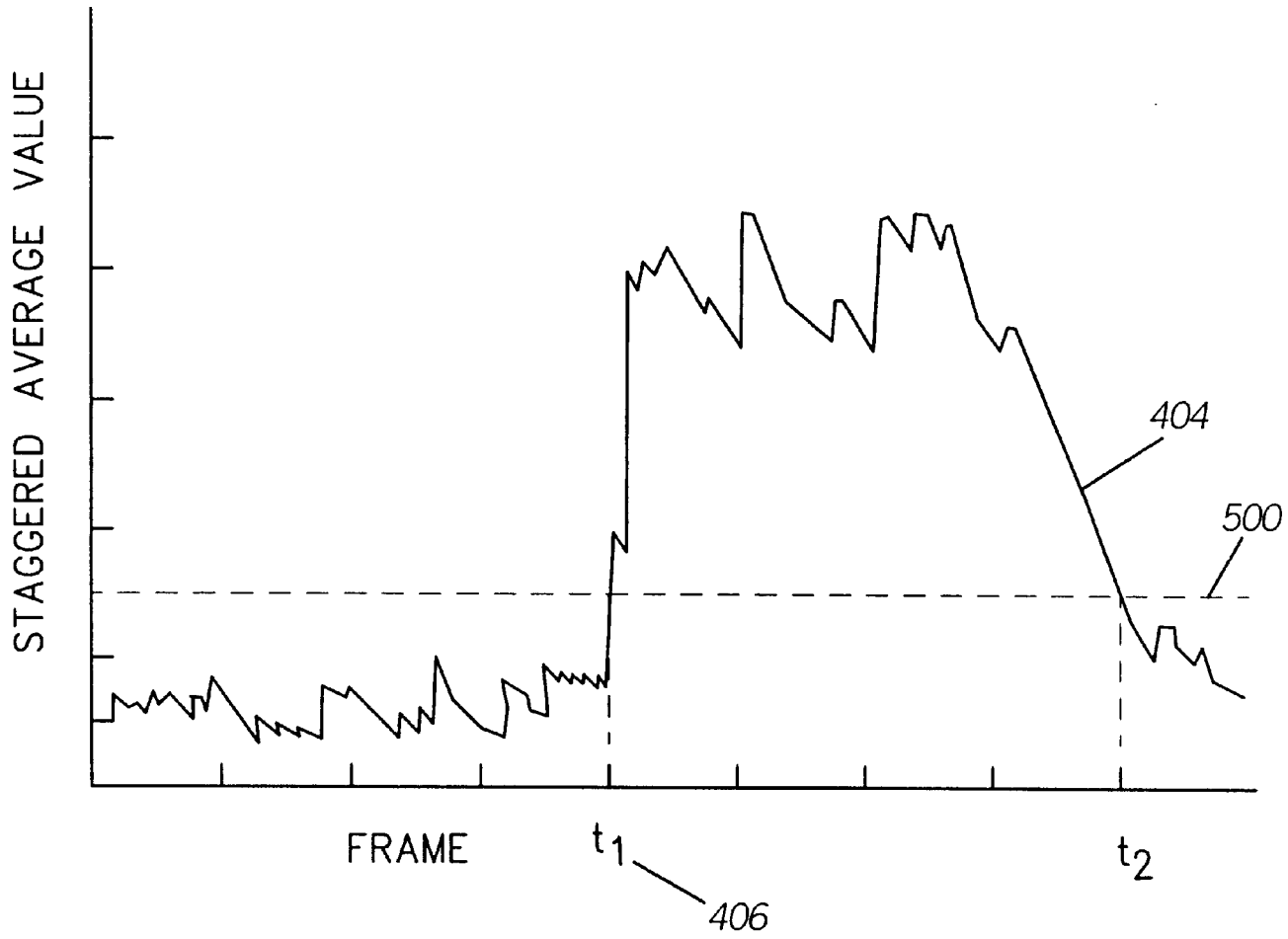
FIG. 5 shows a graph of a staggered average value over time compared to a threshold, in accordance with one embodiment of the invention.

Referring now to FIG. 4, there is shown a graph 400 of frame energy over time and a staggered average value derived therefrom, in accordance with one embodiment of the invention. Frame energy is the solid line 402 while the staggered average value is represented by the broken line. FIG. 5 shows the same graph without the frame energy and only the staggered average value, here as a solid line 404. At some point t, (406), the signal contains speech. In FIG. 5, there is shown a broken line 500 at a constant value of frame energy, and represent a threshold voice indicator value. When the staggered average 404 is greater than the threshold voice indicator value, the processor declares speech to be present in the frame under evaluation. From the graph in FIG. 5, it can be seen that the speaker will therefore be active between points $t_1$ and $t_2$. However, going by the frame energy 402, it can be seen that there are several periods where the frame energy drops below the threshold voice indicator value, as would be the case when a person spoke a sentence where there are brief pauses in speech between words.

Figure 6:
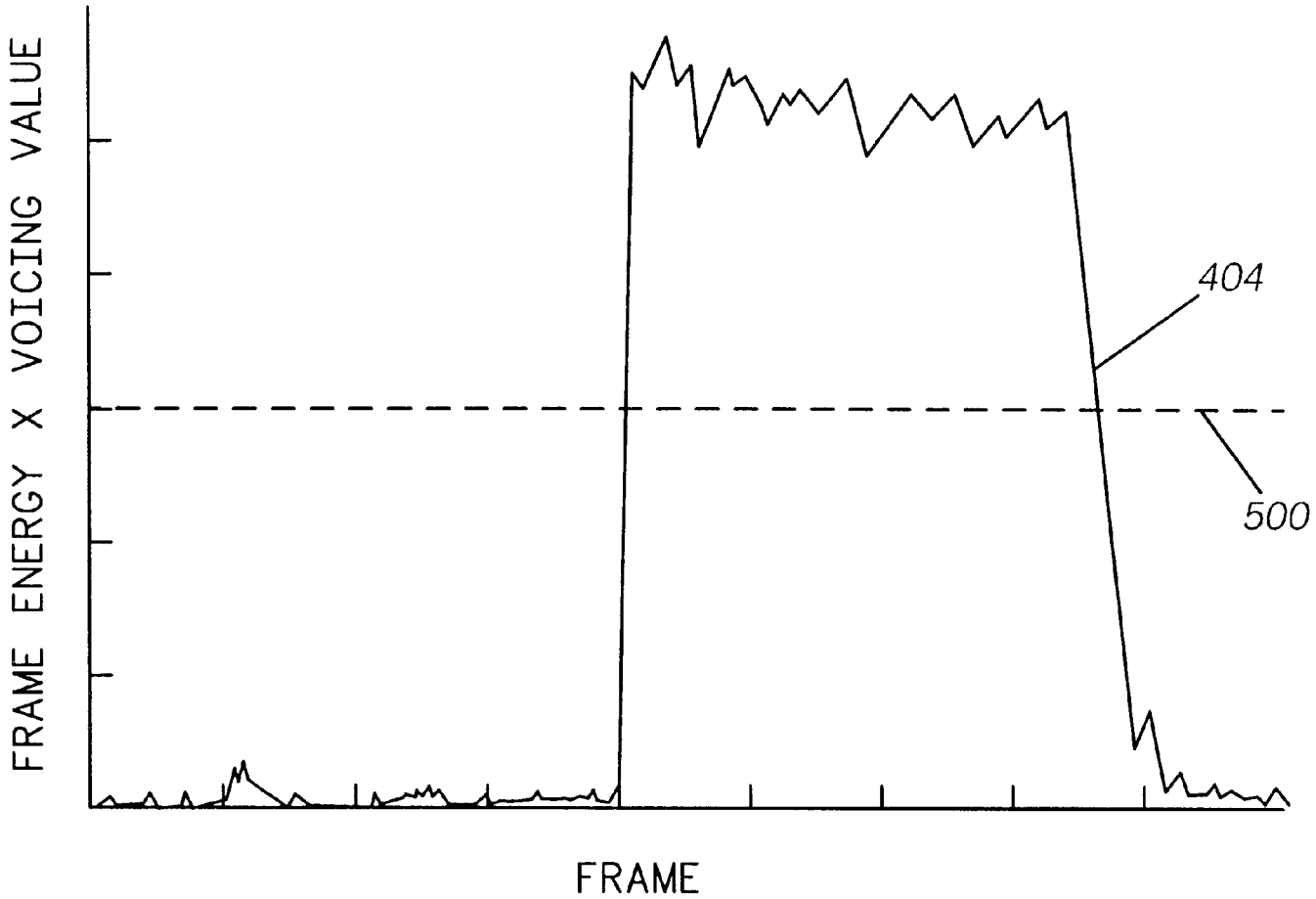
FIG. 6 shows a graph of the product of frame energy value and voicing value over time, in accordance with the invention.

Although detecting speech content in a vocoded signal based on frame energy alone, as in the previous example, is effective, the decision making can be enhanced. It may sometimes be the case that the speech is done in a noisy environment, and some background noise may be present. Typically background noise is highly fricative, and tends to degrade the voicing value associated with speech frames. In the preferred embodiment instead of simply using frame energy alone on which to base decisions, using the product of the frame energy value and the voicing value has been found to sharpen the staggered average value. In VSELP, frame energy is given as r0, which is known to mean the evaluation of the autocorrelation function at the zeroeth position, and voicing values are integers 0, 1, 2, or 3. Thus, frames with high voicing values, even though they may have mid-low range frame energy values, will be emphasized. This effect can be seen in FIG. 6, where the vertical axis, instead of being frame energy alone, is the product of the frame energy value and voicing value. The staggered average value 404 is still derived from the frame energy, but on a frame by frame basis, the emphasis of voicing mode dramatically changes and sharpens the graph over time. This allows the threshold voice indicator value 500 to be increased to further separate frames containing voice content and frames without voice content. At the same time, much of the background noise, which is mostly, if not purely fricative, will result in a product of zero in VSELP. The staggered average value envelope will still allow frames with low voicing values to be declared as speech containing frames, but basing the staggered average value and threshold voice indicator value on the product of frame energy value and voicing value further distinguishes between frames with speech content and frames without.

Figure 7:
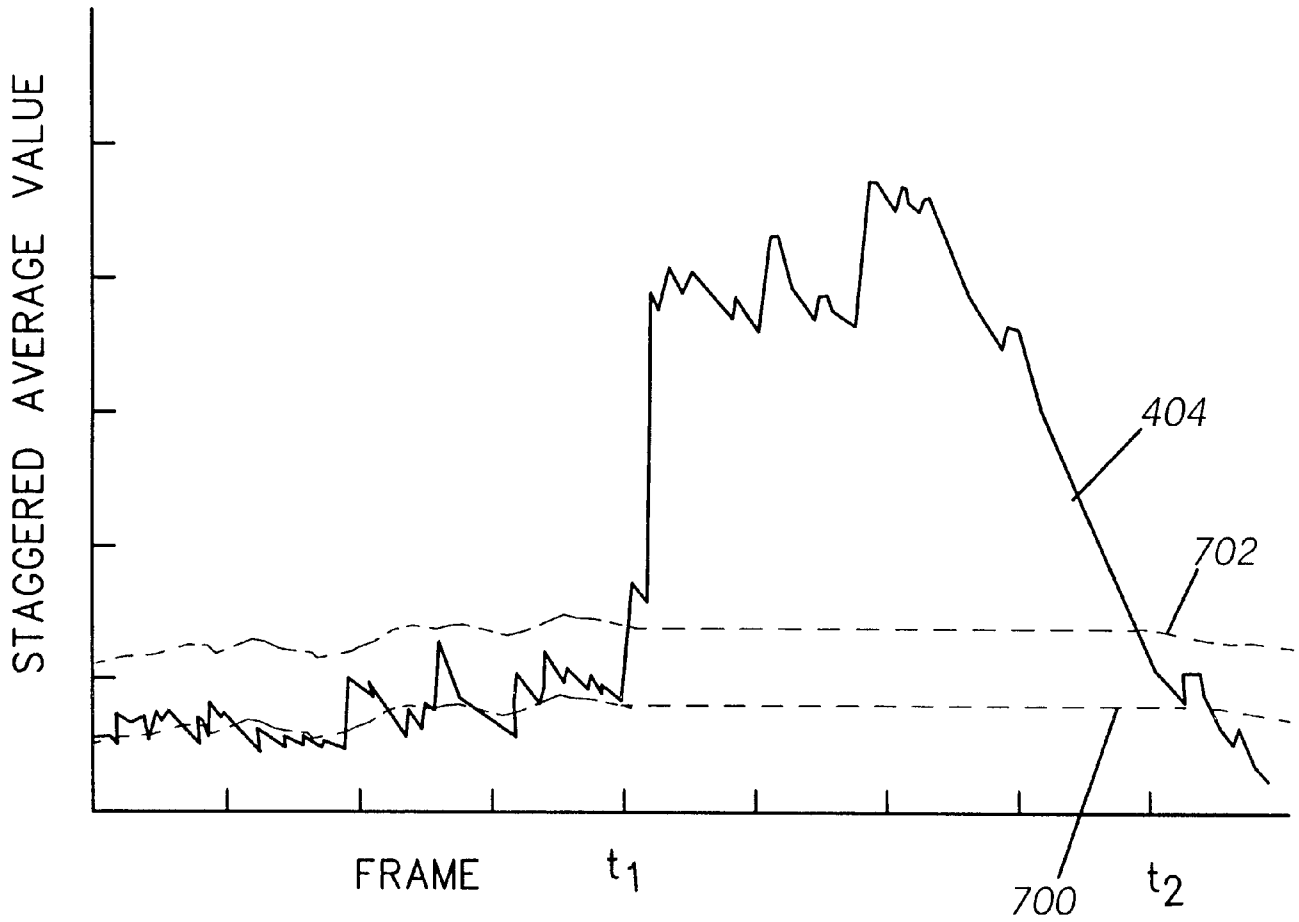
FIG. 7 shows a graph of a staggered average value over time compared to a dynamic threshold, in accordance with one embodiment of the invention.

Another technique that has been found to contribute to the ease of detecting voice in a vocoded signal is illustrated in FIG. 7, and has to do with determining the threshold voice indicator value. Since the threshold voice indicator value is the value that determines when the staggered average value indicates voice is present in the received audio information, it can and should be optimized. In the discussion hereinabove in reference to FIG. 5, the threshold indicator value was shown as a constant value, which will provide acceptable results. However, in the preferred embodiment, the threshold voice indicator value is dynamic, and changes with the average frame energy under non-voiced conditions. In practice, and as shown in FIG. 7, a first frame energy average 700 is calculated, but is only updated when the voicing value is low enough to indicate an unvoiced frame, and the staggered average value is below the threshold voice indicator value. The average is a running average. In the preferred embodiment, using VSELP, the frame energy average is only updated when the voicing value is zero, and the staggered average value falls below the previous threshold voice indicator value. Thus, in the time between $t_1$ and $t_2$ the average 700 remains constant. Outside of that time, and assuming the voicing value is sufficiently low, the average changes with frame energy. The average may, for example, be calculated using the formula $y[n]=a\cdot y[n-1]+(1-a)\cdot x[n]$, described above in reference to calculating the staggered average value, but without the instantaneous changes when the frame energy increases. The dynamic threshold voice indicator value 702 is calculated by adding a preselected constant to obtain an identical graph to the average offset by the constant. It is a matter of engineering choice as to what constant to select. Calculating the threshold voice indicator value in this manner enhances the method by declaring when the received signal is relatively clean and noise free, and reduces the amount of noise.

Figure 8:
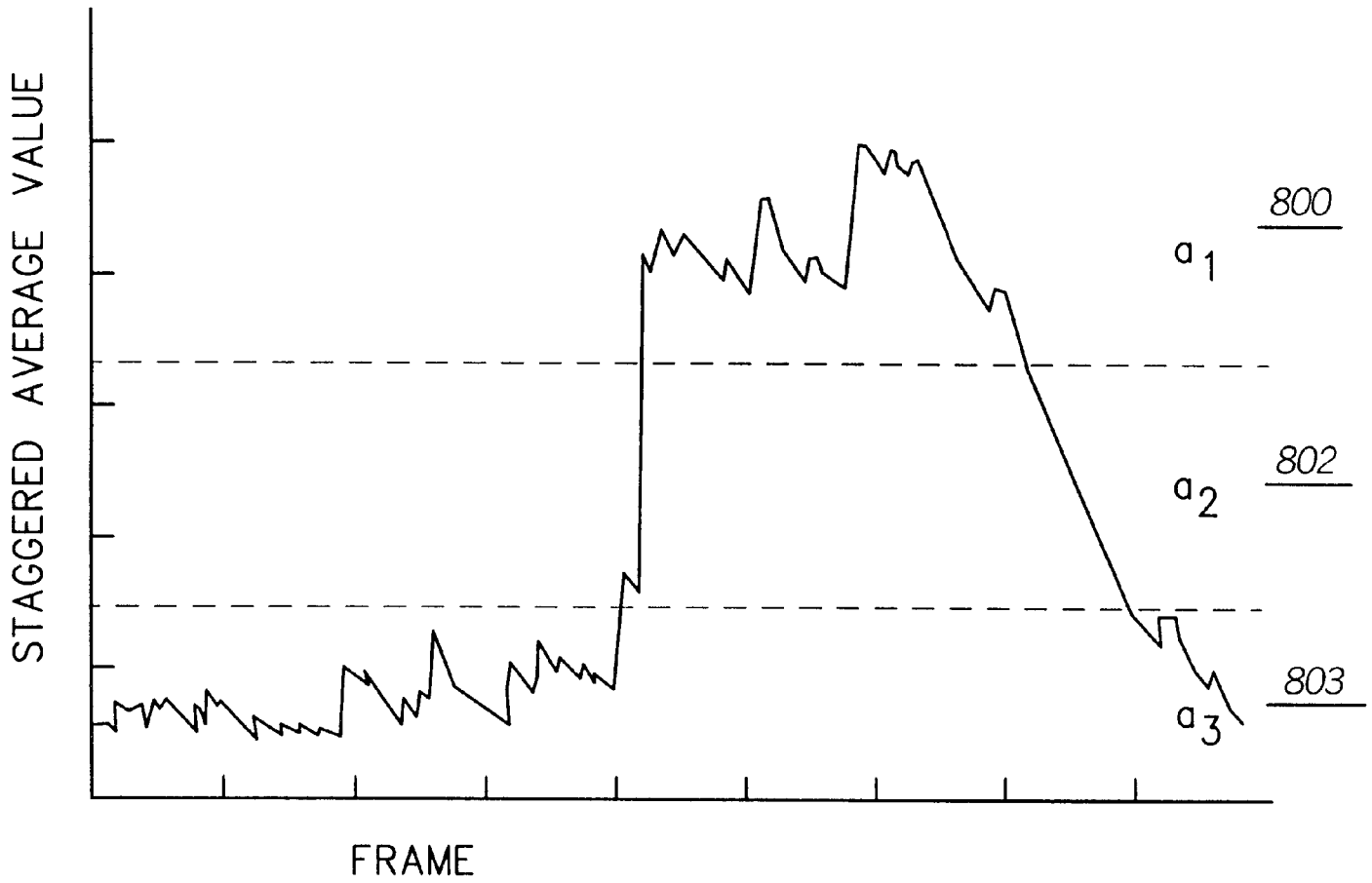
FIG. 8 shows a graph of a staggered average value over time showing separate zones wherein the staggered average value decays at a different rate depending on the present zone, in accordance with one embodiment of the invention.

Another technique that has been found to significantly increase the ability to detect voice in a vocoded signal in accordance with the present invention is described in reference to FIG. 8. Referring now to FIG. 8, there is shown a graph of a staggered average value over time showing separate zones wherein the staggered average value decays at a different rate depending on the present zone, in accordance with one embodiment of the invention. In general the problem here is that when a staggered average value is used, if the speech ends and the staggered average is high, particularly if the product method of calculating the staggered average is used, there may be an excessive lag between the time when the speech ends, and the staggered average value falls sufficiently low so that speech is no longer declared. The result would be that periods of silence would be declared as speech.

To solve this problem, the scaling factor used in the decay calculation of the staggered average value varies with the magnitude of the staggered average value. In general, the higher the staggered average value, the lower the scaling factor. So, in the equation $y[n]=a\cdot y[n-1]+(1-a)\cdot x[n]$, where a is the scaling factor, a decreases as the staggered average value increases. Thus, the higher the staggered average value, the more weight a lower frame energy value or product value (r0·voicing) will have in calculating a new staggered average value. In the preferred embodiment, it has been found that it is sufficient to define zones of the staggered average value, and assign a different scaling factor to each zone. Thus, in a first zone 900, a first scaling factor $a_1$ is used, in a second zone 902 a second scaling factor $a_2$ is used, and in a third zone 903 a third scaling factor $a_3$ is used, where $a_1<a_2<a_3$. By using smaller scaling factors, essentially weighting lower value more in the averaging calculation, less time is required before revoking the declaration of speech. In other words, indicating that no speech is presently detected.

Thus, the present invention provides for a simple and reliable method for detecting voice in a vocoded signal which uses relatively little processing power compared to conventional methods. The fundamental technique is the use of the staggered average value or envelope. The staggered average value is derived from the frame energy, may be exclusively based on frame energy, and in the preferred embodiment it is the product of the frame energy value and the voicing value. To further enhance voice detection, the threshold voice indicator value is dynamic, based on an average of the frame energy updated only when the voicing value is sufficiently low. A third technique used to enhance voice detection is in adjusting the weight given to lower values when updating the staggered average value, based on the present value of the staggered average. Higher present staggered average values result in more weight given to lower frame energy or the product of frame energy and voicing values.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method for detecting speech in a vocoded signal, comprising the steps of:

receiving a vocoded signal having a succession of frames, each frame containing audio information and a corresponding frame energy value;

calculating a staggered average value derived from the frame energy value by:

comparing a current frame energy value with a present staggered average value;

if the current frame energy value is greater than the present staggered average value, setting the staggered average value equal to the current frame energy value; and if the current frame energy value is less than the present staggered average value, calculating a current staggered average value by reducing the present staggered average value by an averaging factor;

providing a threshold voice indicator value; and declaring speech present when the staggered average value is greater than the threshold voice indicator value.

2. A method for detecting speech as defined in claim 1, wherein in the step of calculating, the averaging factor has a form of $y(n)=a\cdot y(n-1)+(1-a)\cdot x(n)$, where:

y(n) is the current staggered average value;

a is a scaling factor having a value from zero to one;

y(n-1) is the present staggered average value; and x(n) is the current frame energy value.

3. A method for detecting speech as defined in claim 2, wherein in the step of calculating, the scaling factor has a value dependent on the current frame energy value.

4. A method for detecting speech as defined in claim 3, wherein in the step of calculating, the value of the scaling factor is dependent on a range of the current frame energy value.

5. A method for detecting speech as defined in claim 1, wherein the vocoded signal comprises a voicing value with each frame, in the step of calculating the staggered average value, the staggered average value is the product of the frame energy value and the voicing value.

6. A method for detecting speech as defined in claim 5, wherein the step of calculating a staggered average comprises:

comparing a product of a current frame energy value and a current voicing value with a present staggered average value;

if the product is greater than the present staggered average value, setting the staggered average value equal to the product; and if the product is less than the present staggered average value, calculating a current staggered average value by reducing the present staggered average value by an averaging factor.

7. A method for detecting speech as defined in claim 6, wherein in the step of calculating, the averaging factor has the form of $y[n]=a\cdot y(n-1)+(1-a)\cdot x(n)$, where:

y(n) is the current staggered average value;

a is a scaling factor having a value from zero to one;

y(n-1) is the present staggered average value; and x(n) is the product of the current frame energy value and the current voicing value.

8. A method for detecting speech as defined in claim 6, wherein in the step of calculating, the scaling factor has a value dependent on the current frame energy value.

9. A method for detecting speech as defined in claim 8, wherein in the step of calculating, the value of the scaling factor is dependent on a range of the current frame energy value.

10. A method for detecting speech as defined in claim 1, wherein in the step of declaring speech, the threshold voice indicator value is a constant value.

11. A method for detecting speech as defined in claim 1, wherein the step of providing a threshold voice indicator value comprises calculating a running average of the frame energy when the staggered average value is below a previous threshold voice indicator value and a voicing value corresponding to the frame energy value indicates an unvoiced frame.

12. A method for detecting speech in a vocoded signal, comprising the steps of:

receiving a vocoded signal having a succession of frames, each frame containing audio information and a corresponding frame energy value and a voicing value;

calculating a staggered average value derived from a product of the frame energy value and the voicing value by:

comparing a current frame energy value with a present staggered average value;

if the current frame energy value is greater than the present staggered average value, setting the staggered average value equal to the current frame energy value; and if the current frame energy value is less than the present staggered average value, calculating a current staggered average value by reducing the present staggered average value by an averaging factor;

providing a threshold voice indicator value; and declaring speech present when the staggered average value is greater than the threshold voice indicator value.

13. A method for detecting speech as defined in claim 12, wherein in the step of calculating, the averaging factor has the form of $y[n]=a\cdot y(n-1)+(1-a)\cdot x(n)$, where:

$y(n)$ is the current staggered average value;

$a$ is a scaling factor having a value from zero to one;

$y(n-1)$ is the present staggered average value; and $x(n)$ is the product of the current frame energy value and the current voicing value.

14. A method for detecting speech as defined in claim 13, wherein in the step of calculating, the scaling factor has a value dependent on the current frame energy value.

15. A method for detecting speech as defined in claim 14, wherein in the step of calculating, the value of the scaling factor is dependent on a range of the current frame energy value.

16. A method for detecting speech as defined in claim 14, wherein in the step of declaring speech, the threshold voice indicator value is a constant value.

17. A method for detecting speech as defined in claim 14, wherein the step of providing a threshold voice indicator value comprises calculating a running average of the frame energy when the staggered average value is below a previous threshold voice indicator value and a voicing value corresponding to the frame energy value indicates an unvoiced frame.

* * * * *